US005654022A

United States Patent [19]

Sayre

[11] Patent Number: 5,654,022

[45] Date of Patent: Aug. 5, 1997

[54] HEAT SHRINK CAPSULE FOR CLOSING FLANGED BOTTLE TOPS

[75] Inventor: David P. Sayre, Healdsburg, Calif.

[73] Assignee: Popcorn Design LLC, Healdsburg, Calif.

[21] Appl. No.: 482,530

[22] Filed: Jun. 7, 1995

[51] Int. Cl.[6] ..... B65D 85/00

[52] U.S. Cl. ..... 426/118; 215/251; 215/253; 215/307; 215/326; 215/308

[58] Field of Search ..... 53/399, 442, 449, 53/176; 206/497; 215/317, 326, 327, 349, 346, 350, 310, 43, 45, 250, 251, 253, 308, 307; 264/230; 426/118, 395; 220/371

[56] References Cited

U.S. PATENT DOCUMENTS

| | | | |
|---|---|---|---|
| 825,116 | 7/1906 | Engels . | |
| 1,857,015 | 5/1932 | Gere | 426/118 X |
| 2,161,097 | 6/1939 | Schroder-Nielsen | 215/307 |
| 2,227,682 | 1/1941 | Wade | 215/246 X |
| 2,328,845 | 9/1943 | Pike et al. . | |
| 2,361,449 | 10/1944 | Benzinger | 215/246 |
| 2,790,285 | 4/1957 | Pike et al. . | |
| 2,790,286 | 4/1957 | Snyder . | |
| 2,954,139 | 9/1960 | Owens | 215/246 |
| 3,272,367 | 9/1966 | Long | 215/251 |
| 3,559,834 | 2/1971 | Taylor | 426/118 X |
| 3,924,771 | 12/1975 | Cleff | 215/246 |
| 4,000,824 | 1/1977 | Han | 215/246 X |
| 4,018,640 | 4/1977 | Amberg | 215/246 X |
| 4,133,724 | 1/1979 | Seino et al. | 215/246 X |
| 4,187,276 | 2/1980 | Amberg . | |
| 4,294,367 | 10/1981 | Otsuka et al. | 215/246 |
| 4,633,648 | 1/1987 | Yeung | 53/442 X |
| 4,724,973 | 2/1988 | Shah . | |
| 4,745,014 | 5/1988 | Hanaya . | |
| 4,803,829 | 2/1989 | Scheidegger . | |
| 4,812,317 | 3/1989 | Taylor | 215/230 X |
| 5,119,965 | 6/1992 | Arduca et al. | 215/251 |

FOREIGN PATENT DOCUMENTS

| | | |
|---|---|---|
| 38468 | 10/1981 | European Pat. Off. . |
| 3008097 | 9/1981 | Germany . |
| 346856 | 4/1931 | United Kingdom . |

*Primary Examiner*—Allan N. Shoap
*Assistant Examiner*—Robin A. Hylton
*Attorney, Agent, or Firm*—Townsend and Townsend and Crew LLP

[57] ABSTRACT

A capsule for placement over bottle tops, particularly tops of bottles of wine having a flanged bottle top which defines a pouring surface surrounding an opening of the bottle closed with a cork and an exterior undercut. The capsule is constructed of a heat shrinkable material, covers the pouring surface, engages the undercut, and includes a weakened break line positioned so that the break line overlies the periphery of the bottle top flange. The capsule is transparent and includes an opaque band at its free, lower end which is dimensioned and positioned to overlie and thereby hide from view a lower end of the cork and a fill line formed by the wine in the bottle. The base of the capsule includes a hole which is about the same size as or slightly larger than the bottle opening. An opaque, preferably metallic, disk is affixed e.g. bonded, to the base of the capsule, overlies and covers the bottle opening, hides the end of the cork from view, and protects the bottle top, the bottle opening, the cork and a pouring surface of the bottle against contamination and tampering.

8 Claims, 2 Drawing Sheets

HEAT SHRINK CAPSULE FOR CLOSING FLANGED BOTTLE TOPS

BACKGROUND OF THE INVENTION

The present invention relates to a seal, commonly referred to as a capsule, which is placed over bottles closed with a cork.

Bottles closed with corks, primarily wine bottles but including bottles holding champagne, spirits, oils, vinegars and the like, usually receive a capsule that is placed over the bottle top to conceal the cork, and in particular its upper, exposed end, to protect the bottle top against contamination, render it tamper-proof, and to give it a more attractive appearance and thereby enhance sales. The present invention is particularly applicable to corked wine bottles, and will be described in relation thereto, because quality wines are sensitive to the manner in which they are stored in the bottle, and this includes the manner in which the cork is protected from the environment while being allowed to breathe. As pointed out, however, it is useful for bottles holding other liquids as well.

As is illustrated in FIG. 1, conventional wine bottles have a relatively thin-walled bottle neck (to reduce the amount of glass and thereby save costs) which terminates in a narrow pouring surface 4 that surrounds the bottle opening. A cork 6 in the opening protects the wine in the bottle until use. A capsule 8, typically made of an inert metal such as Tin or a plastic-metal foil laminate, is placed over the bottle top after the insertion of the cork and spun against the exterior of the bottle. It protects the cork against contamination and tampering and gives the bottle a more attractive appearance by hiding from view the fill line of the bottle (to which the wine is filled) and the lower end of the cork, which are considered unattractive. It is extensively used to enhance the overall appearance of the bottle by applying color, design and printing onto it.

Such wine bottles have a narrow flange some distance below the pouring surface of the bottle which retains the capsule on the bottle. The flange also forms a ledge along which the top portion of the capsule can easily be cut from a remainder thereof just prior to use to bare the pouring surface and so that the cork could be pulled from the bottle opening.

Wine bottles are frequently opened with levered corkscrews which have an arm that rests against the pouring surface when the cork is pulled. This creates high, localized surface pressures on the pouring surface which can damage it; e.g. by chipping portions of the glass. For a variety of reasons, including a potential danger of injuries, this is highly undesirable.

To alleviate this problem, wine bottles with an enlarged top flange 10 as illustrated in prior art FIG. 2 have recently come into use. The top flange has a larger diameter than the remainder of the bottle neck, is relatively thick (typically at least about 5 mm), and presents a much larger pouring surface 4. As a result, damage to the pouring surface during cork removal has been greatly reduced if not eliminated altogether. However, the enlarged top flange made it much more difficult to protect the bottle top in general and the pouring surface and the cork in particular since the conventional way of applying a capsule can no longer be used.

The large undercut 12 formed by top flange 10 prevents conventional metallic bottle capsules from being spun onto the bottle. To nevertheless provide a measure of protection, a protective metal seal disk 14 was dropped into the bottle opening and secured to the top surface of the cork with a layer of beeswax, or a wax or paraffin seal was placed into the bottle opening so that it is substantially flush with the pouring surface. Neither, however, adequately protects the cork and therewith the contents of the bottle since they are relatively easy to remove. This raises the danger that sealing disks or wax seals can become accidentally lost, which subjects the cork and therewith the contents of the bottle to potential contamination, or intentionally removed, permitting a tampering with the cork and/or the contents of the bottle, and thereafter be replaced, which might prevent a detection of the tampering. In addition, the layer of beeswax, or the paraffin seal, isolates the cork from the air, which, over time, can compromise the quality of the wine in the bottle.

Moreover, the pouring surface of the bottle remains unprotected at all times and, for appearance purposes, the absence of a capsule makes it necessary to apply an opaque band, such as an adhesive paper band 16, about the bottle neck to hide the fill line and the lower end of the cork from view. The application of the band is relatively burdensome because the band is typically imprinted and/or decorated and its relative positioning on the bottle must be coordinated with the positioning of the labels (front and back) to assure the desired overall appearance of the bottle. This requires relatively sophisticated and, therefore, expensive machinery for finishing the bottles on automatic bottling lines and increases bottling costs.

SUMMARY OF THE INVENTION

The present invention makes the use of wine and other bottles with an enlarged top flange safe and feasible by providing a capsule which can be placed over the top flange and which protects the cork and the contents of the bottle, as well as the pouring surface, against contamination and undetected tampering. This is achieved by making the capsule of a heat shrinkable material so that, upon shrinkage, it encapsulates the entire top of the bottle, including its cork, and which is constructed so that it does not constitute an impediment to opening the bottle when it is time to use its contents.

Generally speaking, the capsule extends across the entire top of the bottle and, prior to its application to the bottle, it has a downwardly depending capsule wall of a sufficient diameter so that it can be dropped over the top flange, and its lower end is positioned below the fill line of the bottle. Upon the application of heat, the wall shrinks and contracts until it engages the exterior of the bottle, including the periphery of the top flange. The wall engages the undercut beneath the top flange, which firmly secures the capsule to the bottle and prevents its removal therefrom while the flat base of the capsule covers and protects the pouring surface and the cork. To enable a ready and virtually effortless removal of the capsule, it has a score line of perforations in that portion of the wall which overlies the periphery of the top flange; that is, at a location on the flange periphery which is spaced from both the pouring surface of the bottle and the undercut. The perforations are sized and positioned so that upon the removal of the cork; for example, by first conventionally inserting a spiral cork puller through the top of the capsule into the cork and then applying a leveraged pulling force against the arm of the corkscrews while it rests against the pouring surface to pull the cork out of the bottle opening, the part of the capsule located above the score line breaks off. The remainder of the capsule, which engages the undercut and the bottle neck, stays on the bottle.

This eliminates the heretofore common practice of first cutting the capsule with a knife, then manually removing it, and thereafter inserting the corkscrew and pulling the cork. This task is relatively easy with metal or composite capsules because they are pliable and easily cut with a knife along the ledge formed by the narrow flange of the bottle beneath the pouring surface.

No such cutting ledge is available on a wine bottle with an enlarged top flange. Heat shrink capsules are further much more difficult to cut and tear than metal capsules and the cut has to be made above the undercut and beneath the top flange so that the top of the capsules can be pulled off the bottle. Thus, without the score line placed a very short distance; e.g. 5 mm or less, from the pouring surface of the bottle, a heat shrink capsule would have to be manually cut along the narrow cylindrical periphery of the top flange without any guide or support. For less than highly skilled persons, this would lead to a constant danger of a slipping knife and resulting finger cuts.

With a score line, the need for making any cut is eliminated. Instead, the simple act of pulling the cork severs the top of the capsule along a clean, circular break line circumscribing the periphery of the top flange. The bottle is ready for immediate use since the pouring surface was protected by the capsule up to the moment of pulling the cork.

Thus, a bottle of wine constructed and finished in accordance with the present invention includes a top flange which defines a relatively wide pouring surface and which surrounds the bottle opening in which the bottle closing cork is located. The periphery of the top flange has a larger diameter than the bottle neck and an underside which defines the earlier mentioned undercut. The lower end of the cork is spaced slightly above the wine fill line of the bottle, and the heat shrinkable capsule is placed over the top of the bottle, covers the entire bottle top (including the bottle opening and the pouring surface), the top flange and its periphery, the undercut, and both the fill line and the lower end of the cork. The score line in the capsule is located on the periphery of the top flange and it is shaped and formed to facilitate the breakage of the upper part of the capsule from a remainder thereof when the cork is pulled.

The capsule preferably includes a hole in its top which is substantially aligned with and of a diameter preferably not substantially less than the diameter of the bottle opening. A relatively easily pierced (e.g. with a corkscrew) disk made of a material such as metal foil, a plastic-metal foil laminate, or a plastic with a metalized surface, for example, and having a diameter greater than the capsule diameter covers the bottle opening and has its periphery secured to the portion of the capsule surrounding the capsule hole; for example, by bonding and/or mechanically compressing or stamping the overlapping portions of the disk and the capsule together. This not only facilitates the insertion of the corkscrew, because metal foils, for example, are much more easily pierced than the relatively hard shrink wrap materials, it makes it possible to construct the capsule of a transparent material while covering the usually unattractive top surface of the cork. Not only is the cork covered, the disk can be given an appealing color and/or attractive designs, lettering and the like, all of which enhance the merchandisability of the overall bottle. Vent holes are included in the disk for use with wine bottles to permit the cork to breathe to maintain and/or enhance the quality of the wine while it is stored in the bottle. In this manner the present invention not only protects the top of flanged wine bottles, it makes the use of the attractive flanged bottles feasible for even expensive premium wines because the cork is allowed to break through the vent hole in the disk.

By constructing the capsule of a transparent heat shrink material, the sides of the cork in the bottle opening remain visible. Thus, attractive designs, lettering, trademarks, messages and the like can be imprinted on the sides of the cork and will be displayed to further enhance the attractiveness of the overall package.

Finally, the lower end of the shrink wrap capsule preferably includes an opaque band; for example, by imprinting or otherwise applying a color onto the lower portion of the capsule wall during its manufacture. The band has a sufficient height so that it overlies and hides from view the lower cork end and the bottle fill line. This eliminates the need for opaque bands which had to be separately applied in the past.

Due to the cost of glass, the height or thickness of the enlarged top flange will normally be limited. It will rarely reach a height of 20 mm, it will usually be in the range of between about 3 to 15 mm, presently preferred top flange heights are in a range of between 5 to 10 mm, and it appears that a flange height of about 5 mm will become most widespread. Thus, a capsule can be constructed in accordance with the present invention for subsequent application to the bottle top by a heat shrink process by providing a capsule blank having a circular base of a diameter about equal to the outer diameter of the top flange from which a tubular wall extends so that the capsule can be dropped over the top flange. The tubular wall has a score line of perforations which, in a presently preferred embodiment, are spaced from the base of the capsule by no more than 10 mm, and preferably by no more than about 5 mm, to assure that, upon installation on the bottle, the score line will always come to rest on the periphery of the top flange and be spaced from both the pouring surface and the undercut defined by the flange.

DESCRIPTION OF THE PREFERRED EMBODIMENTS

Figure 1:
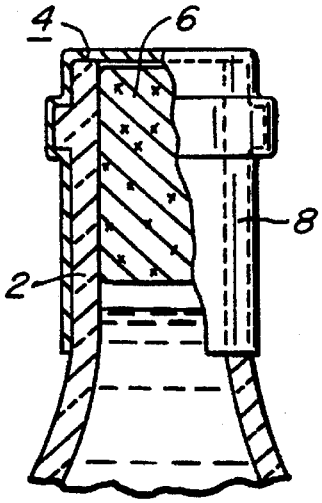
FIG. 1. (PRIOR ART)
FIG. 1 is a fragmentary side elevational view, partially in section, of a wine bottle top covered by a spun-on capsule as used in the past.
Figure 2:
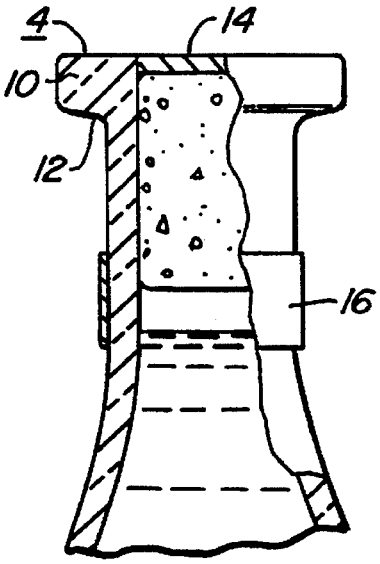
FIG. 2. (PRIOR ART)
FIG. 2 is a fragmentary, side elevational view similar to FIG. 1 and illustrates a wine bottle with an enlarged top flange constructed and closed in accordance with the prior art.
Figure 3:
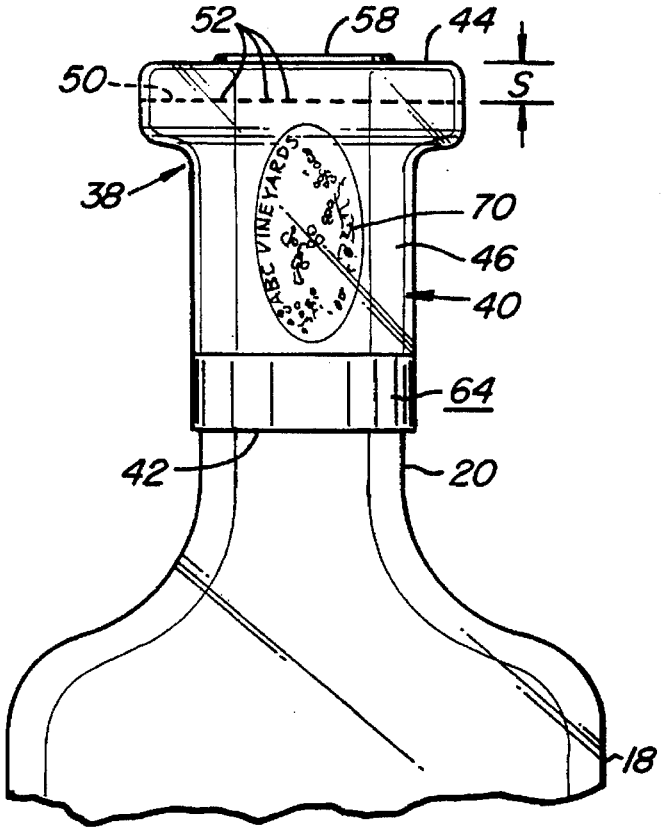
FIG. 3 is a side elevational view of a wine bottle top covered with a heat shrinkable, transparent plastic capsule in accordance with the present invention.
Figure 4:
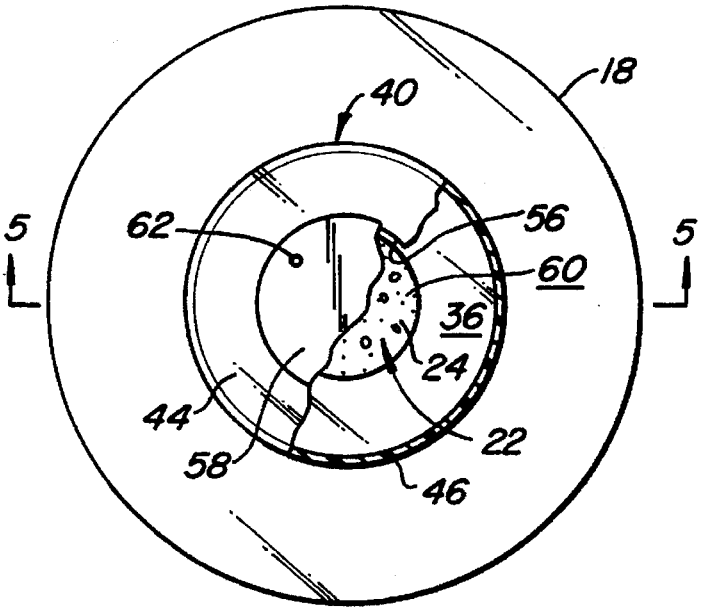
FIG. 4 is a plan view of the bottle shown in FIG. 3 with the capsule broken away to show the bottle top underlying the capsule.
Figure 5:
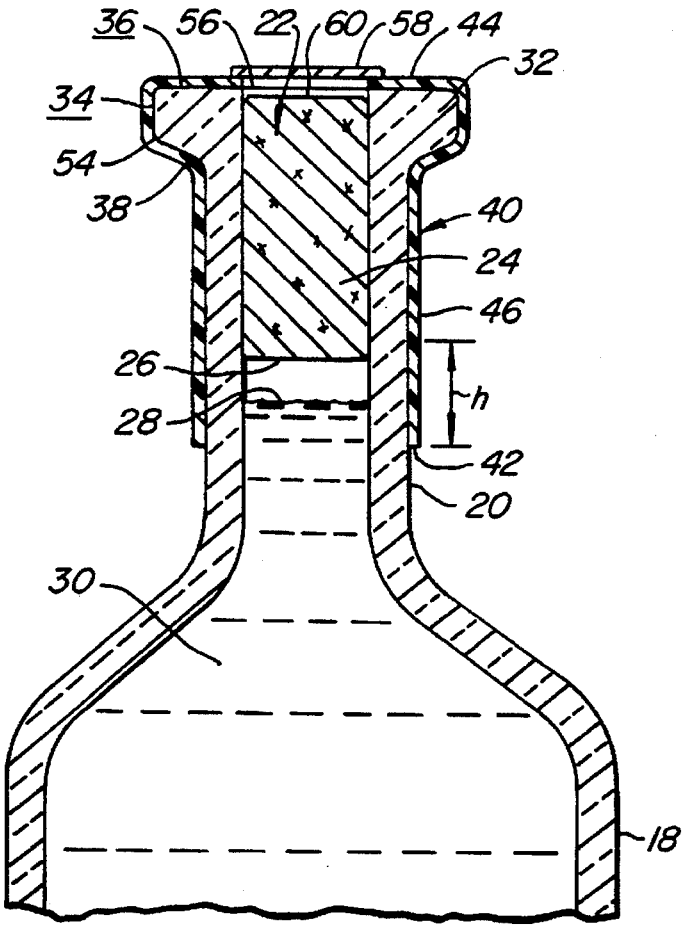
FIG. 5 is a side elevational view, in section, and is taken on line 5—5 of FIG. 4.
Figure 6:
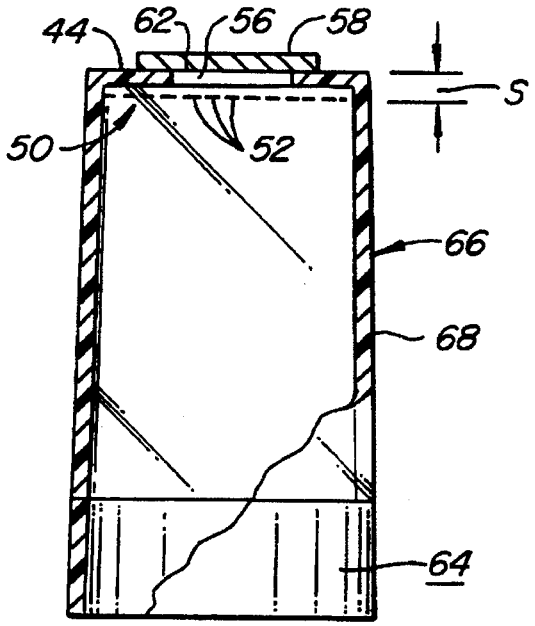
FIG. 6 is a side elevational view, partially in section, of a bottle capsule blank constructed in accordance with the present invention and prior to its application to a bottle top.

Referring to FIGS. 3–5, a bottle of wine 18 has a bottle neck 20 the interior of which forms bottle opening 22 which is closed by a cork 24. A lower end 26 of the cork is spaced from a fill line 28 formed by wine 30 in the bottle. The upper end or top of the bottle forms a top flange 32, a periphery 34 of which has a diameter which is greater than the diameter of the bottle neck. The upper side of the flange defines a flat pouring surface 36 which surrounds bottle opening 22, and the underside of the flange defines an undercut 38. A capsule 40 constructed in accordance with the present invention is applied over the bottle top and extends downwardly over at least a portion of the length of the bottle neck to a free end 42 which is located beneath bottle fill line 28, as is shown in FIG. 5.

The capsule includes a top or base 44 which extends across the entire diameter of top flange 32 and therefore covers pouring surface 36 as well as cork 24 in bottle opening 22. The capsule has a tubular side wall 46 of a shape complementary to the exterior shape of top flange 32, undercut 38 and bottle neck 20 extending downwardly from the undercut. This shape is attained by constructing the capsule of any one of a number of well-known and widely available heat shrink materials and by heat shrinking the capsule through the application of heat until it has substantially acquired the exterior shape of the bottle top and follows its exterior outline, as is well illustrated in FIG. 3.

The capsule has a score line 50 of a multiplicity of serially arranged, spaced-apart perforations 52. The score line entirely overlies the periphery 34 of top flange 32 (see FIG. 3); that is, the score line is positioned between and spaced from pouring surface 36 above and the beginning of the undercut at about the intersection 54 between the periphery of the top flange and its underside.

Top 44 of capsule 40 includes a hole 56 which is substantially aligned with bottle opening 22 and which has a diameter not substantially less than and preferably slightly more than the diameter of the bottle opening. A preferably circular disk 58 has a diameter greater than the diameter of capsule hole 56. Its periphery overlaps and is secured to the portion of the capsule surrounding the hole; for example, by bonding, welding, mechanical compression and the like. The disk covers and protects the bottle opening and whatever portion of the pouring surface 36 is located radially inward of the capsule opening.

The disk 58 is constructed of an opaque material, to hide cork top surface 60 from view, and is preferably made of metal foil or a plastic-metal foil composite, both of which are well known and widely available. The disk may be given a color coordinated with the overall packaging and coloring scheme of the bottle, it may include a design, a logo, a trademark and the like to enhance its appearance, and, at least for bottles of wine, it preferably includes as least one small (e.g. 0.5–1.5 mm) diameter vent hole 62 so that air can communicate with the Space immediately overlying cork top surface 60 to permit the cork to breathe.

An opaque band 64 at the lower end of tubular wall 46 has a height "h" sufficient so that the band covers lower cork end 26 and fill line 28, as is illustrated in FIG. 5. Similar to disk 58, the opaque band can be given a color selected to enhance the attractiveness of the entire package, coordinated with the overall color scheme of the bottle, and may receive designs, logos, printed matter and the like. It can be formed in any desired manner, such as by applying a color coating to the otherwise transparent tubular capsule wall.

Although the capsule can be made opaque; e.g. painted over its entirety, for example, when attempting to imitate opaque metal capsules, in a presently preferred embodiment of the invention the capsule, except for the opaque band 64 and disk 58, is constructed of a transparent heat shrinkable material so that the periphery of cork 24 remains visible through the capsule side wall 46. This provides an opportunity for placing attractive decorations, designs, logos and the like to the cork surface, as is illustrated by oval imprint 70 in FIG. 3. Alternatively and additionally, of course, the material of the capsule can be chosen to be colored, semitransparent, translucent or the like, as may be appropriate and desired.

Referring now to FIGS. 3–6, the capsule is supplied as blanks 66 defined by capsule top or base 44 of a diameter about equal or slightly larger than the diameter of top flange periphery 34 so that the blank can be readily dropped over the flange. The blank preferably includes the hole 56 and a disk 58 which covers the hole, is constructed of an appropriate material, and is secured to the base of the capsule at the portions where the two overlap. The blank further has a tubular, straight; e.g. cylindrical or slightly tapered, side wall 68 with opaque band 64 at its lower end. Finally, the blank includes the score line 50 of serially arranged perforations 52 which is substantially parallel to the base of the blank and spaced therefrom by a distance "S" selected so that the score line is entirely located on top flange periphery 34. In a presently preferred embodiment, the spacing S of the score line from the base of the capsule blank is no more than about 5 mm.

Turning now to the installation and use of the capsule, after filling and corking, a capsule blank 66 is dropped over the top of the bottle so that capsule base 44 rests against pouring surface 36. This will automatically substantially align the capsule hole 56 with bottle opening 22.

Heat is now applied to the capsule, and in particular to its tubular side wall 68 to induce shrinking until the side wall has taken on the exterior shape of top flange 32 and bottle neck 20, as is shown in FIGS. 3 and 5. The application of heat to shrink heat shrinkable materials onto bottle tops is well known and, therefore, is not further described herein. Since the capsule is rotationally symmetric, it need not be aligned with, for example, labels applied to the main body of the bottle. This greatly simplifies the application of the capsule to the bottle and makes it a relatively inexpensive operation.

As soon as heat shrinking has been completed, the bottle is ready for storage and use. When it is desired to open the bottle, a conventional corkscrew tip is pressed against disk 58, which is easily pierced by the tip, particularly when the disk is constructed of a relatively soft material such as Tin or aluminum foil, for example. After turning the corkscrew into the cork, the lever arm of the corkscrew (if used and not separately shown) is placed against the portion of the capsule overlying the pouring surface, and the cork is then pulled. Pulling the cork applies an upwardly directed force against capsule top 44, which breaks the top part of the capsule along the score line and lifts it off the lower-part of the capsule, which is retained on bottle neck 22 by undercut 38.

The opened bottle of wine has a clean, previously fully protected pouring surface so that pouring can commence immediately without the need for wiping or otherwise cleaning it. No remnants of the capsule protrude past the pouring surface where they could interfere with pouring the wine. Moreover, the score line presents a clean break line for the capsule to maintain the attractiveness of the bottle even after it has been opened.

What is claimed is:

1. A bottle containing wine comprising an upright bottle neck terminating in a pouring surface surrounding an opening of the bottle, a cork closing the opening, an exterior of the neck forming a topside contiguous with the pouring surface extending downwardly therefrom and terminating in an undercut, and a capsule constructed of a heat shrinkable material, placed against and covering the opening, the pouring surface, the top side and the undercut so that a portion of the capsule in the undercut prevent a removal of the capsule from the bottle neck, the capsule including a weakened break line encircling the exterior top side of the bottle so that applying aa force to the cork sufficient to remove it from the bottle opening causes breakage of the capsule along the break line and a removal of a portion of the capsule above the break line with the removal of the cork from the opening to thereby ready the bottle for pouring, the capsule having a capsule top which covers the bottle opening and the pouring surface and which has a hole in substantial alignment with and of a diameter no less than a diameter of the bottle opening, and a disk made of a material other than the material of a remainder of the capsule which fully covers the bottle opening and the capsule top hole and which has at least one vent hole formed in the disk in a portion thereof overlying the capsule hole.

2. A bottle containing wine according to claim 1 wherein the disk is made of metal foil.

3. A bottle containing wine according to claim 1 including means securing the disk to the capsule.

4. A bottle containing wine according to claim 1 wherein the disk has a diameter greater than the capsule hole, and including a bonding agent securing the disk to the capsule so that the disk fully covers the capsule hole.

5. A bottle containing wine according to claim 1 wherein the disk has a diameter greater than the diameter of the capsule hole, and wherein overlapping portions of the disk and the capsule are mechanically secured to each other.

6. A bottle containing wine according to claim 1 including a marking carried on a peripheral surface of the cork and positioned so that the marking is visible through the capsule.

7. A bottle containing wine according to claim 1 wherein the capsule top is spaced from the break line by no more than about 10 mm.

8. A bottle containing wine according to claim 1 wherein the capsule top is spaced from the break by no more than about 5 mm.

* * * * *